US006966088B1

(12) United States Patent
Hu

(10) Patent No.: US 6,966,088 B1
(45) Date of Patent: Nov. 22, 2005

(54) CUSHION TO SUPPORT PATIENT WITH BED SORES

(76) Inventor: Mary D. Hu, 12234 Kerrwood St., #3, El Monte, CA (US) 91732

( * ) Notice: Subject to any disclaimer, the term of this patent is extended or adjusted under 35 U.S.C. 154(b) by 0 days.

(21) Appl. No.: 10/922,012

(22) Filed: Aug. 18, 2004

(51) Int. Cl.[7] ..... A47C 27/00; A47G 9/00
(52) U.S. Cl. ..... 5/630; 5/652.1; 5/944
(58) Field of Search ..... 5/630, 652.1, 638, 5/731, 735, 724, 944

(56) References Cited

U.S. PATENT DOCUMENTS 2,085,296 A * 6/1937 Carey
3,974,532 A * 8/1976 Ecchuya ..... 5/724
4,255,824 A 3/1981 Pertchik
4,278,079 A * 7/1981 Simhoni et al. ..... 128/892
4,688,285 A * 8/1987 Roberts ..... 5/630
4,750,224 A 6/1988 Stracke
4,777,679 A 10/1988 DeLooper
4,779,297 A * 10/1988 Sturges ..... 5/630
5,153,956 A * 10/1992 Nold ..... 428/218
5,402,545 A * 4/1995 Jolley ..... 5/653
5,628,079 A * 5/1997 Kizemchuk et al. ..... 5/653
6,223,368 B1 5/2001 Anslin
6,321,402 B1 * 11/2001 Ming-Chung ..... 5/636
6,473,924 B1 11/2002 Sorbo
6,550,085 B2 4/2003 Roux

* cited by examiner

*Primary Examiner*—Alexander Grosz
(74) *Attorney, Agent, or Firm*—Raymond Y. Chan; David and Raymond

(57) ABSTRACT

A cushion to support patient with bed sores has a top sidewall, a bottom sidewall, an outer lateral sidewall and an inner lateral sidewall defining an aperture therewithin. An outer lateral sidewall periphery of the outer lateral sidewall is greater than an inner lateral sidewall periphery of the inner lateral sidewall. A plurality of ventilation channels are formed on at least one of the top sidewall and bottom sidewall of the cushioning support for promoting blood circulation and air ventilation for the bed sores of the patient.

7 Claims, 6 Drawing Sheets

CUSHION TO SUPPORT PATIENT WITH BED SORES

BACKGROUND OF THE PRESENT INVENTION

1. Field of Invention

The present invention relates to medical treatment accessory, and more particularly to a cushion to support patient with bed sores for preventing the bed sore(s) of a patient from receiving any pressure and contacting with any object, including the bed or chair surface.

2. Description of Related Arts

People or hospital patients who are bedridden for extended periods of time become afflicted with various skin maladies, such as wounds, sores, ulcers, and various surface conditions, as a result of poor blood and air circulation. The most common form of affliction is known as a decubitus ulcer or bed sore. The part of the body making contact with a bed or support device is under pressure by the weight of the body urging against the bed or supporting device, thus resulting in muscle and associated tissue becoming compressed and stiffened. This situation is most acute when the bone of a patient presses on the tissue, such as the spine, coccyx or tailbone, hips, heels, and elbow. The weight of the patient's body presses upon the bone, which presses upon adjacent tissue and skin. As a result, blood circulation decreases and the tissue begin to decay. The patient may also experience muscle pain and cramps as normal levels of oxygen and nutrition that would otherwise be delivered to muscles are decreased because reduced blood circulation. The outer layer of the skin or epidermis becomes weakened and loses its resiliency and ability to sustain injury and heal.

Furthermore, the part of the body making direct contact with the bed or support surface is prevented from receiving an adequate supply of air or air circulation necessary to promote healing of any wounds, ulcers, or sores caused by an extended stay in bed.

Ulcers or bed sore are generally characterized in severity over five stages: Stage 1, characterized by surface discoloration (pinkish or reddening) of the kin; Stage 2, broken or unbroken blistering; Stage 3, extension of wound through all layers of the skin; Stage 4, extension of wound through the skin, underlying muscle, tendon, and bone; and Stage 5, generally referring to an extremely deep wound affecting underlying organs and bone.

The part of the body that is most prone to bed sore is the sacral vertebrae region, that is the five pieces of bones above the coccygeal vertebrae and the lowest four pieces of bones of the spine. The reason is that the spine forms a natural curve, which curves out the most in the sacral vertebrae region. Hence, when a body is lying on a bed, in order to obtain support for the entire spine from the bed surface or the mattress, the sacral vertebrae region is pressed against the bed surface the hardest, pushing the bed surface downwards and at the same time creating a large pressure on the sacra vertebrae region.

Eventually, for a bedridden patient, day after day, the pressure decreases blood circulation and tissue being to decay. In some extreme cases, the skin and tissue of the sacreal vertebrae region is so decayed that the bones underneath are exposed. As can be imagined, the patient would be under a huge amount of constant pain.

The most common method of prevention involves having the patient change position over a regular interval, generally every two hours, so as to relieve and distribute pressure and weight over the body. In some cases, the patient can change position unaided, but in many situations nursing care must be provided to help a patent change position at the prescribed interval. The changing of position typically involves rolling the patient, although other methods and procedures may be used depending upon the condition of the patient.

However, not all patients can change position at regular intervals to relieve pressure so as to prevent the formation of an ulcer or to prevent the worsening of an existing ulcer. In such situations, a cushion or other device may be positioned under or adjacent to the wound between the patient and the bed to relieve pressure or redistribute pressure away from the wound. Ideally, the body should be supported above the bed or support surface at a height sufficient to allow to pass through and circulate over all parts of the body otherwise making direct contact with the bed or support surface in order to permit wounds, ulcers, and sores to dry out and heal without affecting or compromising the comfort of the patient.

Cushions and similar devices of various shapes are available for this function. A common type of cushion, for instance, is a circular cushion with a central aperture, frequently referred to as a "doughnut" cushion. This type of cushion is less than effective in relieving or redistributing body pressure over or adjacent to a wound as the cushion transfers the body weight or pressure to the circular portion of the cushion making contact with the body. Furthermore, the circular portion making contact with the body forms an airtight seal, which prevents air from circulating over and around the wound as needed to promote healing of the wound.

The subject of the instant invention introduces an patient cushion for wound support that can be placed under a bedridden patient in order to promote blood circulation necessary for reducing muscle pain, stiffness, and cramps and to provide air circulation over exterior wounds, sores, and ulcers resulting from an extended stay in a bed, such that said air circulation will aid in healing of said wounds, sores and ulcers.

Numerous designs for various medical support cushions have been provided in the prior art. Even though these designs may be suitable for the specific individual purposes to which they address, they would not be suitable for the purposes of the present version of the invention. These patents are exemplified by the following:

- U.S. Pat. No. 4,255,824, Cushion for Decubitus Ulcers, issued to Pertchik on 17 Mar. 1981;
- U.S. Pat. No. 4,750,224, Flexible Support, issued to Stracke on 14 Jun. 1988;
- U.S. Pat. No. 4,777,679, Inflatable Cushion with Central Opening, issued to DeLooperon 18 Oct. 1988;
- U.S. Pat. No. 6,223,368, Support Device, issued to Anslin on 1 May 2001;
- U.S. Pat. No. 6,473,924, Support Pad, issued to Sorbo et al. on 5 Nov. 2002; and
- U.S. Pat. No. 6,550,085, Support for Expansible Cells, issued to Roux on 22 Apr. 2003.

As such, it may be appreciated that there is a continuing need for a new and improved patient cushion with central aperture, having one side thereof covered with a series of protuberances that impinge upon skin and muscle tissue during use of the cushion in order to promote blood circulation in and around muscle tissue, thus reducing muscle pain and stiffness; and to provide air circulation between said protuberances so that wounds, sores, and ulcers can heal during use of said cushion. In these respects, the present version of the invention substantially departs from the conventional. Concepts and designs of the prior art, and in so doing provide an apparatus that substantially fulfills this need. Additionally, the prior patents and commercial techniques do not suggest the present inventive combination of component elements arranged and configured as disclosed herein.

SUMMARY OF THE PRESENT INVENTION

It is an object of the invention to provide a low-cost, easy-to-manufacture, and easy-to-market cushion to support patient with bed sores.

A further object of my version of the invention is to provide an easy-to-use and versatile cushion to support patient with bed sores.

A significant object of the invention is to provide a cushion to support patient with bed sores that is comprised of a soft, resilient filler material with an outer layer and configured into a circular shape with central aperture; and smooth bottom sidewall, and a top sidewall covered with a series of protuberances extending above said top sidewall for some distance and arrayed into a series of concentric circles or circular rows extending from the central aperture to the outer sidewall of said cushion, said protuberances separated by gaps between individual circular rows and by gaps between individual straight rows of protuberances extending from the central aperture in a spoke like pattern.

A final but very significant object of the invention is to provide a cushion to support patient with bed sores that aids reduces discomfort associated with wounds, sores, ulcers, and the like resulting from extending stay in a bed and promotes healing of said wounds, sores, ulcers, and the like by increasing blood circulation in muscle and associated tissue of said wounds and ensuring air circulation over said wounds.

For a better understanding of the invention, its operating advantages and the specific objects attained by its uses, reference should be made to the accompanying drawings and descriptive matter in which there is illustrated a preferred embodiment of the invention. The foregoing has outlined some of the more pertinent objects of the invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention illustrated by the accompanying drawings.

The present invention, which is described in greater detail hereinafter, relates to the field of specialized patient support cushions for wounds, sores, ulcers, and other similar afflictions. More particularly, the present invention relates to a soft, resilient cushion configured into a circular shape with central aperture and covered on a top side thereof with a series of protuberances that support a portion of user above the top side thereof while allowing beneficial circulation of air between said protuberances to aid in healing of wound, ulcer, or other affliction. The present invention overcomes all of the shortcomings listed previously, in addition to novel aspects that will be described in detail hereinafter.

Described briefly, according to a preferred embodiment, the invention presents a cushion to support patient with bed sores that is configured as a circular cushion with central aperture. As such, the cushion is comprised of a top sidewall, opposed bottom sidewall, outer lateral sidewall, and inner lateral sidewall. The central aperture is bounded by the inner lateral side. The top sidewall is covered with a series of protuberances that extend above the top sidewall for some distance therefrom. The height of the protuberances is scaled to impinge upon adjacent skin and muscle tissue during use of the cushion to aid in and promote blood circulation through and around adjacent skin and muscle tissue.

The protuberances are arrayed into a series of concentric circles emanating from the central aperture up to the outer lateral sidewall of the cushion. Furthermore, the protuberances in each circle are aligned in straight rows extending from the central aperture in a spoke like pattern. As such, the protuberances are separated by a first set of gaps between each row of concentric circles and a second set of gaps between each straight row of protuberances.

The two sets of gaps provide maximum air circulation around the protuberances during use of the cushion to aid in ventilation of wounds, ulcers, sores, and the like of bedridden patients. The cushion can be inserted under the legs, torso, and arms of a patient when the patient is lying in a bed or behind the back or neck of a patient when the patient is sitting up.

Since the sacral vertebrae region is most prone to bed sores or like conditions, due to the fact that the spine curves out the most in that region, which causes the region to sustain most pressure when the body is lying flat on a bed, the present invention can be used to prevent such bed sores, or helping healing when such bed sores occur.

The cushion can be inserted between the body and the bed surface in such a manner that different regions of the spine sustain more or less the same amount of the pressure, such that blood circulation rate is maintained, avoiding the decay of tissue, such as aligning the sacral vertebrae with the central aperture or applying the entire cushion onto the lumbar vertebrae region.

Furthermore, in order to maximize the function of providing ventilation to the body by the cushion, the bottom sidewall is not of a flat surface, but a curved surface, preferable wavy surface, such that gaps are formed between the bottom sidewall and the mattress or bed surface so as to further prevent the formation of the airtight seal and provide additional ventilation channels between for the body.

The present invention, therefore, resides not in any one of these features per se, but rather in a particular combination of all of them herein disclosed. It is distinguished from the prior art in this particular combination of all of its structures for the functions specified.

In order that the detailed description of the invention may be better understood and that the present contribution to the art can be more fully appreciated, additional features of the invention will be described hereinafter. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart form the spirit and scope of the invention.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application or is it intended to be limiting as to the scope of the invention in any way.

BRIEF DESCRIPTION OF THE DRAWINGS

The foregoing and other objects, features and advantages of the invention will become more fully understood from the following description of the preferred embodiment of the invention as illustrated in the accompanying drawings in which like reference characters refer to the same parts throughout different view. The drawings are not necessarily to scale, emphasis instead being placed upon illustrating the principles of the invention.

DRAWING REFERENCE NUMERALS

10 Cushion to Support Patient with Bed Sores
12 Top Sidewall
14 Outer Lateral Sidewall
16 Inner Lateral Sidewall
18 Aperture
20 Protuberance
22 Bottom Sidewall
24 Circular Row
26 Straight Row
28 Gap
30 Gap
32 Filler Material

DETAILED DESCRIPTION OF THE PREFERRED EMBODIMENT

Figure 1:
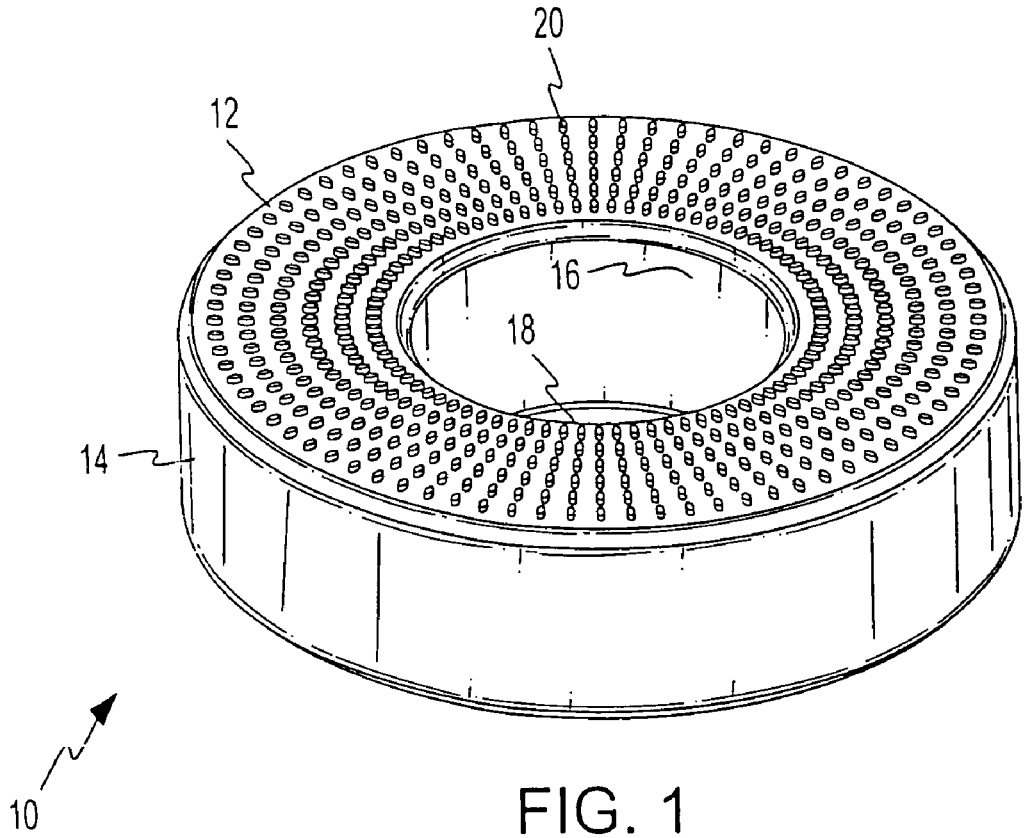
FIG. 1 is a top perspective view of a cushion to support patient with bed sores in accordance with a preferred embodiment of the present invention.

Referring now to the drawings and, in particular, to FIG. 1 wherein there is illustrated a typical embodiment of the cushion to support patient with bed sores 10. The present version of the invention 10 is used to support the body of a person or portion thereof above a support device, such as bed in order to promote air and blood circulation at or in the vicinity of a wound, sore, ulcer, and the like. The provision of such air and blood circulation reduces discomfort associated with such skin afflictions and aids in healing thereof relieving and redistributing body weight and promoting air circulation over a portion of the body supported by said cushion. The cushion is circular and may be provided in various sizes (i.e. diameters and thicknesses) to accommodate a variety of patients, afflictions, and applications, such as a hospital, hospice, home, or other setting.

The cushion is comprised of a top sidewall 12, outer lateral sidewall 14, opposed inner lateral sidewall 16, central apertures 18 defined by said inner lateral sidewall 16. The outer lateral sidewall 14 and inner lateral sidewall 16 are disposed in perpendicular relation to the top sidewall 12, although said sidewalls 14, 16 may curve slightly outward in a convex manner. A series of protuberances 20, which are arrayed into a series of concentric rings or circles, extend above the space of the top sidewall 12 for some distance therefrom and are separated from each other 20 by gaps, as will be described in more detail later in this disclosure. As such, the individual protuberances 20, pressing against the skin of a patient, promote blood circulation through adjacent muscles and air circulation through the gaps around the protuberances 20, thus aiding in the prevention and healing of wounds, sores, ulcers, and the like.

Figure 2A:
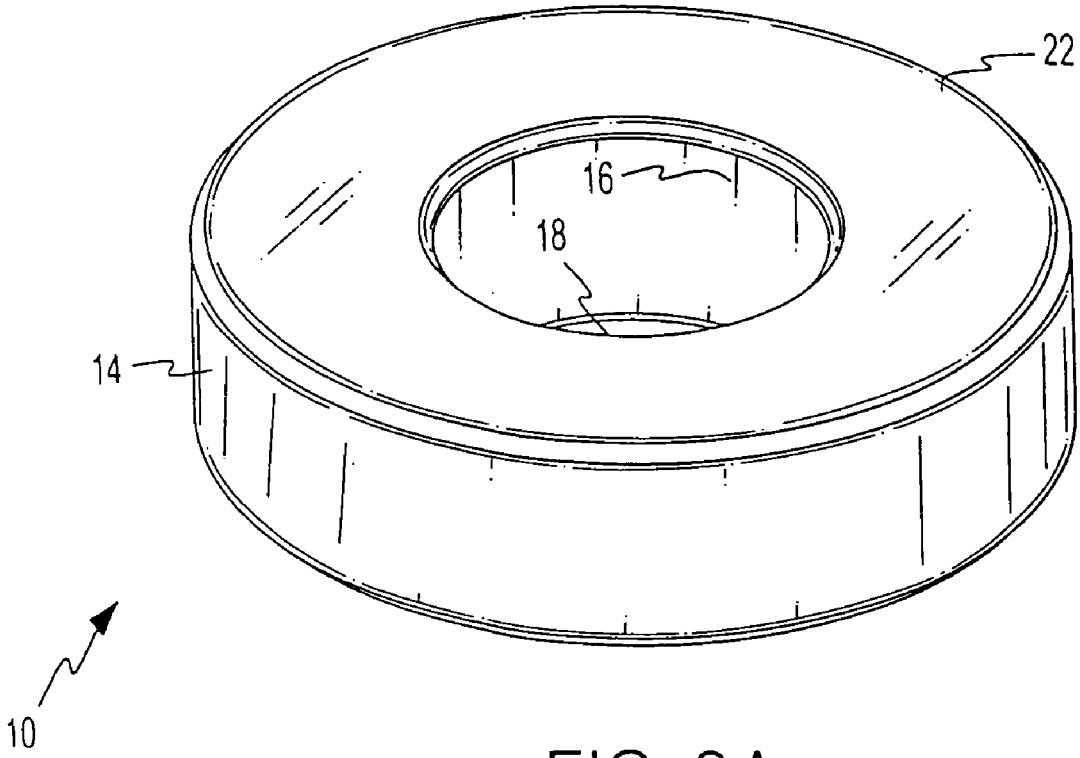
FIG. 2A is a bottom perspective view of a cushion to support patient with bed sores in accordance with the above preferred embodiment of the present invention.

Referring to FIG. 2, therein illustrated is the bottom side of the cushion to support patient with bed sores 10. A bottom sidewall 22 is located between opposed edges of the outer 14 and inner 16 lateral sidewalls. The bottom sidewall 22 presents a smooth and continuous surface.

Figure 3:
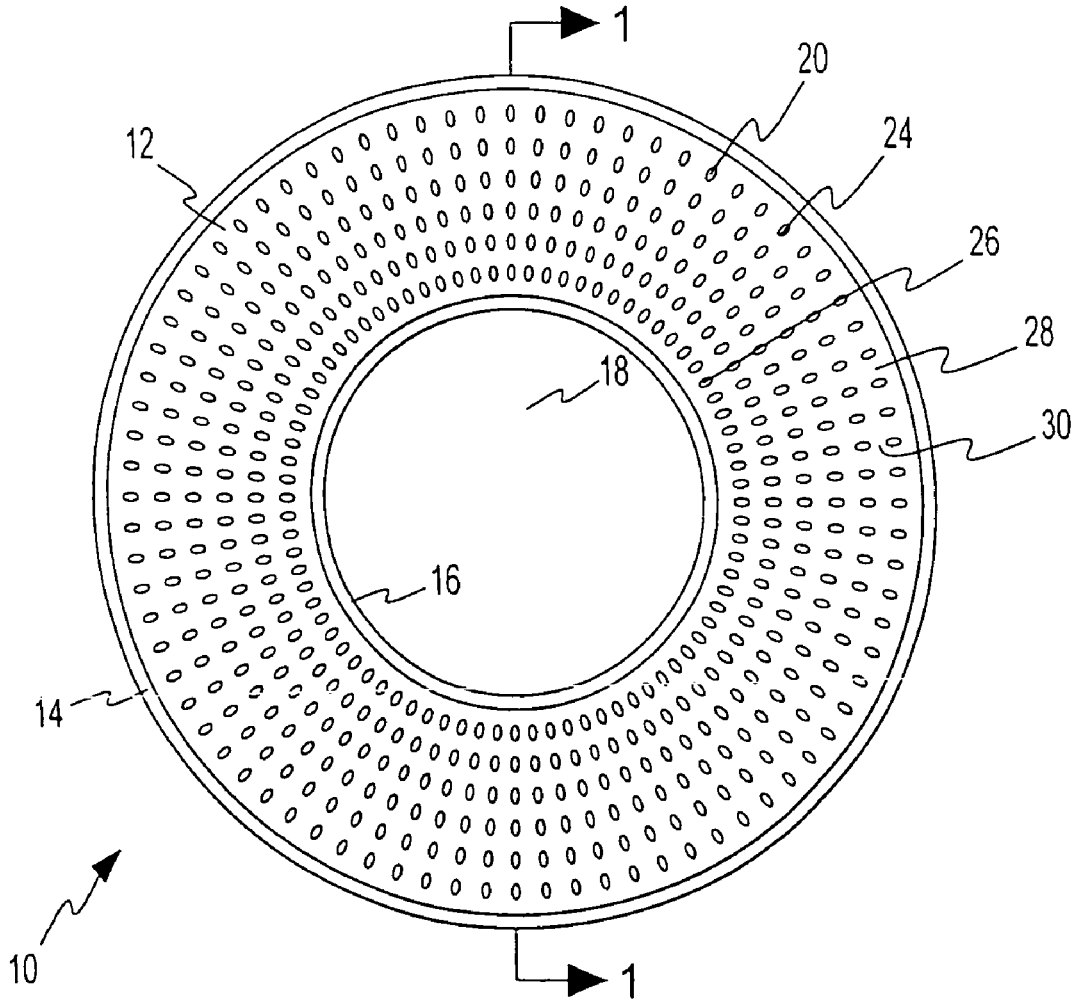
FIG. 3 is a top plan view of the cushion to support patient with bed sores in accordance with the above preferred embodiment of the present invention.

As displayed most clearly in FIG. 3, the protuberances 20 of the cushion 10 are arrayed in a series of concentric circles or circular rows 24 between the outer lateral sidewall 14 and inner lateral sidewall 16. In this version of the invention six circular rows 24 of protuberances 20 are illustrated. In other versions of the invention 10, the number of concentric circles or circular rows 24 of protuberances 20 can vary, along with the outer lateral sidewall 14) and inner diameter (measured from opposed edges of the inner lateral sidewall 16) of the cushion 10. Furthermore, the protuberances 20 of each circular row 24 are aligned in a straight row 26 in the manner of a spoke extending from a hub, in this case the central aperture 18. In this manner, the protuberances 20 aligned in said rows 24, 26 are separated by first gaps 28 between straight rows 26 of protuberances 20 and by second gaps 30 between circular rows 24 of protuberances 20.

Figure 4:
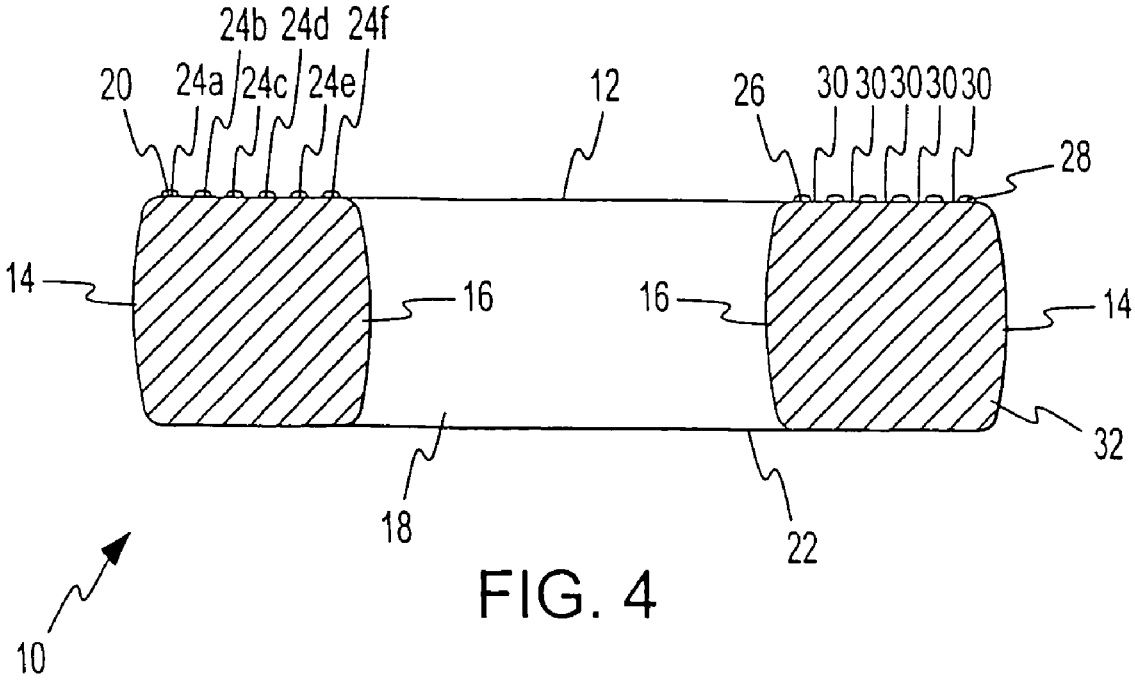
FIG. 4 is a partial cross-sectional view of the cushion to support patient with bed sores taken along line 1—1 of FIG. 3 in accordance with the above preferred embodiment of the present invention.

The cushion to support patient with bed sores 10 is shown in partial cross sectional view in FIG. 4. The protuberances 20 extend for some distance above the top sidewall 12 of the cushion 10 at a height that allows the protuberances 20 to impinge upon the skin of a patent in order to promote blood circulation in adjacent muscles and tissue; and are separated by gaps 28, 30 to promote air circulation therebetween. The protuberances 20 in this version of the invention 10 are configured into six concentric circular rows 24*a, b, c, d, e, f* and configured into individual, straight rows 26 extending from the central aperture 18.

The cushion 10 is comprised of filler material 32 and an outer layer that covers the material and protects said material 32 from being soiled, stained, or damaged. The filler material 32 is soft, resilient, and able to conform to the shape of the body or portion thereof of the user while providing proper support of a particular muscle or body part as needed. The interior of the protuberances 20 may be comprised of filler material 32. Conversely, the protuberances 20 may be fabricated of a relatively rigid or stiff substance, such as plastic, in order to aid in blood circulation of the muscles and associated tissue and to ensure that the gaps 28, 30 between the protuberances 20 do not become blocked, closed, or otherwise obstructed when the body of a user is pressed against the top sidewall 12 of the cushion 10.

The cushion 10 is used with a patient by situating said cushion 10 upon a particular location of a bed or support surface, ensuring that the bottom sidewall 22 makes contact with said bed or support surface. A patient or user can then rest against or upon the cushion 10 by situating a wound, ulcer, or skin affliction over the aperture 18 of the cushion 10 as necessary. Conversely, the wound, ulcer, or skin affliction may be situated over the protuberances 20 if the wound, ulcer or skin affliction extends beyond the boundary of the aperture 18, if the cushion 10 is moved relative to its initial position against the body of the patient, or if the patient desires the protuberances 20 to press against particular skin condition to aid in blood circulation. In any case, the protuberances 20 impinging against skin and muscle tissue will promote blood circulation, and the gaps 28, 30 between the protuberances 20 will promote air circulation over the wound, ulcer or skin affliction. As a result, the blood and air circulation will reduce discomfort for the patient and promote healing of the wound, ulcer, or skin affliction.

Figure 2B:
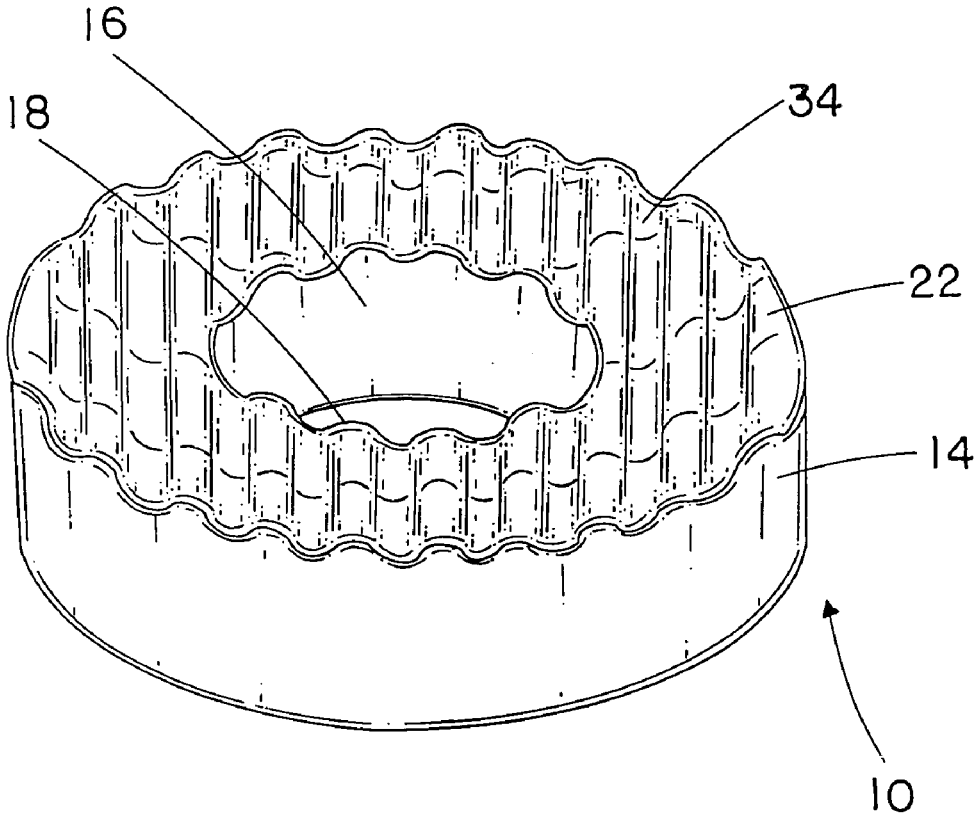
FIG. 2B illustrates an alternative mode of the bottom sidewall of the cushion to support patient with bed sores in accordance with the above preferred embodiment of the present invention.

Furthermore, in order to maximize the function of providing ventilation to the body by the cushion 10, as illustrated in FIG. 2B, the bottom sidewall 22 can be alternatively made to be a non-flat surface, that is an irregular or curved surface, preferable a wavy surface, such that air channels 34 are formed on the bottom sidewall 22 to provide additional air ventilation between the bottom sidewall 22 and the bed surface through the air channels 34 so as to further prevent the formation of the airtight seal situation for the patient body. It is obvious that the wavy surface as shown in FIG. 2B can be formed on the top sidewall 12 and the protuberances 20 formed on the top sidewall 12 can also be applied to the bottom sidewall 22. The protuberances 20 and the wavy surface as shown in FIG. 2B simply demonstrate different alternative modes of providing the ventilation channels on either the top sidewall 12 and the bottom sidewall 22 or both.

Figure 5:
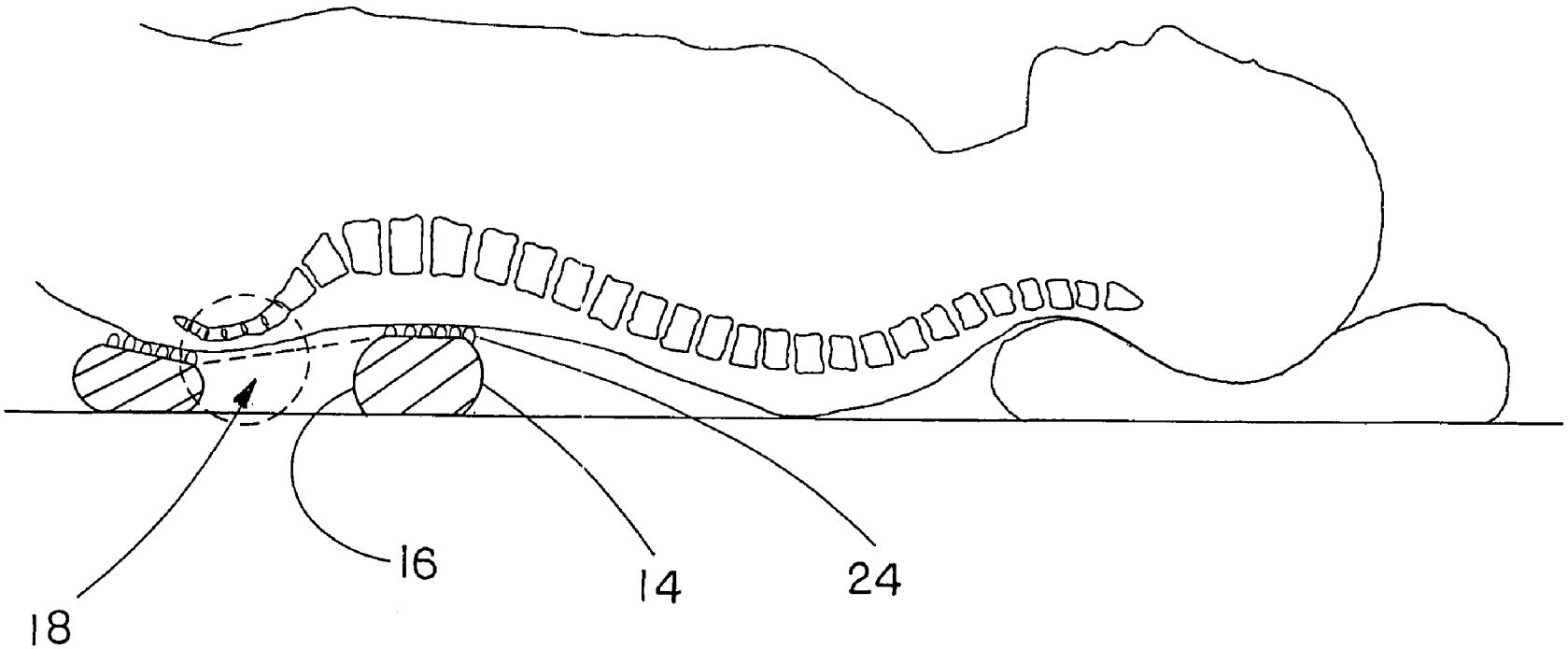
FIG. 5 is a schematic view illustrating the cushion being used to prevent bed sores at the sacral vertebrae region of a patient body in accordance with the above preferred embodiment of the present invention.

FIG. 5 illustrates a sacral vertebrae region of a patient body which is most prone to bed sores or like conditions (the sacral vertebrae region is encircled by the circular broken line in FIG. 5). Due to the fact that the spine curves out the most in that region, it causes the region to sustain most pressure when the body is lying flat on a bed. The present invention can substantially be used to prevent such bed sores, or helping healing when such bed sores occur by preventing the sacral vertebrae region of the patient body to contact with bed surface or even receive any pressure and by allowing air ventilation occurred between the sacral vertebrae region with the environment through the ventilation channels provided by the present invention. The cushion 10 can be inserted between the body and the bed surface in such a manner that different regions of the spine sustain more or less the same amount of the pressure, such that blood circulation rate is maintained, avoiding the decay of tissue, such as aligning the sacral vertebrae with the central aperture or applying the entire cushion onto the lumbar vertebrae region.

While the present invention has been illustrated and described in detail in the drawings and foregoing description, the same is to be considered as illustrative and not restrictive in character, it being understood that only the preferred embodiment has been shown and described and that all changes and modifications that come within the spirit of the version of the invention are desired to be protected. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

From the foregoing, it will be understood by persons skilled in the art that an improved cushion to support patient with bed sores has been provided. The invention is relatively simple and easy to manufacture, yet affords a variety of uses. While my description contains much specificity, these should not be construed as limitations on the scope of the version of the invention, but rather as an exemplification of the preferred embodiment thereof. The foregoing is considered as illustrative only of the principles of the invention. Furthermore, since numerous modifications and changes will readily occur to those skilled in the art, it is not desired to limit the invention to the exact construction and operation shown and described, and accordingly all suitable modifications and equivalents may be resorted to, falling within the scope of the invention. Although this invention has been described by its preferred form has been made only by way of example and numerous changes in the details of construction and combination and arrangements of parts may be resorted to without departing from the spirit and scope of the invention.

What is claimed is:

1. A cushion for supporting a patient with bed sores, comprising a cushioning support which has a top sidewall adapted for supporting the patient, a wavy shaped bottom sidewall adapted for placing on a supporting surface for the patient, an outer lateral sidewall and an inner lateral sidewall defining an aperture therewithin the aperture extending between said top sidewall and said bottom sidewall, wherein an outer periphery of said outer lateral sidewall is larger than said inner periphery of said inner lateral sidewall, wherein said aperture has a predetermined size for enabling said inner lateral sidewall to surround the bed sores of the patient and said top sidewall has a predetermined size for supporting a surrounding portion of the bed sores of the patient to ensure the bed sores of the patient are positioned at said aperture without contacting with the supporting surface, wherein said cushioning support has a ring shape and said aperture has a circular shape and is located in a center of said cushioning support, wherein said cushioning support further has one or more ventilation channels communicating said aperture with outside environment for allowing air ventilation from the outside environment to the bed sores of the patient at said aperture, wherein a plurality of protuberances are formed on said top sidewall of said cushioning support so as to define said ventilation channels therebetween, wherein said protuberances are arranged in a plurality of equally spaced circular rows coaxially formed on said top sidewall with respect to said aperture on said cushioning support, wherein each of said plurality of protuberances has a predetermined height and hardness so as to provide an adequate pressure for supporting the surrounding portion of the bed sores for promoting blood circulation and ensuring air ventilation for the bed sores of the patient.

2. The cushion, as recited in claim 1, wherein said protuberances are uniformly arranged on said top sidewall of said cushioning support.

3. The cushion, as recited in claim 2, wherein said circular rows of said protuberances are aligned in such a manner that each said circular row contains same numbers of said protuberances.

4. The cushion, as recited in claim 3, wherein said cushioning support comprises an outer cover and a filler material, wherein said outer cover provides a protection to said filler material.

5. The cushion, as recited in claim 2, wherein said cushioning support comprises an outer cover and a filler material, wherein said outer cover provides a protection to said filler material.

6. The cushion, as recited in claim 1, wherein said circular rows of said protuberances are aligned in such a manner that each said circular row contains same numbers of said protuberances.

7. The cushion, as recited in claim 1, wherein said cushioning support comprises an outer cover and a filler material, wherein said outer cover provides a protection to said filler material.

* * * * *